United States Patent [19]

Buck

[11] Patent Number: 4,995,476

[45] Date of Patent: Feb. 26, 1991

[54] SAFETY ATTACHMENTS FOR LADDERS

[76] Inventor: Robert J. Buck, Box 263, St. Marys, W. Va. 26170

[21] Appl. No.: 525,990

[22] Filed: May 21, 1990

[51] Int. Cl.[5] ..... E04C 7/48

[52] U.S. Cl. ..... 182/206; 182/107; 182/214

[58] Field of Search ..... 182/206, 107, 214; 248/210

[56] References Cited

U.S. PATENT DOCUMENTS

| | | | |
|---|---|---|---|
| 1,522,292 | 1/1925 | Enssle | 182/107 |
| 1,658,191 | 2/1928 | Gravning | 182/206 |
| 2,232,414 | 2/1941 | Swann | 182/206 |
| 2,778,556 | 1/1957 | Johnson | 182/206 |
| 3,336,999 | 8/1967 | McSwain | 182/206 |
| 4,090,587 | 5/1978 | Pyle | 182/206 |
| 4,469,195 | 9/1984 | Sartain | 182/206 |

*Primary Examiner*—Reinaldo P. Machado
*Attorney, Agent, or Firm*—Anthony A. O'Brien

[57] ABSTRACT

A safety attachment for a ladder is disclosed as including an extruded channel fixed to the top of the ladder with a screw shaft having left and right hand threads disposed in the channel, pole engaging arms extend from guides mounted on the shaft threads for movement of the arm to engage and disengage relative to the pole. A pulley fixed to the shaft rotates the same by means of a rope having ends extending toward the bottom of the ladder whereby the pulley may be operated either at the top or the bottom of the ladder.

9 Claims, 4 Drawing Sheets

SAFETY ATTACHMENTS FOR LADDERS

BACKGROUND OF THE INVENTION

The present invention relates to safety devices for ladders and, more particularly, to a safety attachment securing the top of a ladder to a pole or the like.

The prior art is exemplified by U.S. Pat. No. 1,522,292 dated Jan. 6, 1925 wherein an attachment on the top of a ladder includes a pair of arms at the top of a ladder are adjusted by a rope-operated pulley which is located centrally between the ladder rails. The pulley includes two grooves for two separate ropes, one for each direction of rotation for rotating two shafts and their arms to move a ladder toward or away from a wall or the like. This patent does not include the structure or function of Applicant's invention nor the unusual safety features.

U.S. Pat. Nos. 2,778,556 dated Jan. 22, 1957, 4,090,587 dated May 23, 1978 and 4,469,195 are further examples of the prior art but none of such patents has any disclosure to a safety attachment with a pulley located on the side of a ladder to effect rotation of a shaft for clamping and releasing a ladder to a pole or the like.

OBJECTS OF THE INVENTION

An object of the present invention is construct a safety attachment for securing the top of a ladder to a pole or the like and operated from the bottom of the ladder.

The present invention has another object in that a ladder may be clamped to a pole and the like by a safety arrangement operated from the top or the bottom of the ladder.

A further object of this invention is to provide a pole ladder with a safety attachment located at the top of the outside of the plane of the ladder.

BRIEF SUMMARY OF THE INVENTION

The present invention is summarized in that a safety attachment for clamping a ladder to a pole or the like includes a support mount adapted to be secured to the rails of a ladder, a channel member carried by the mount and having convergent flanges with spaced apart end portions, spaced bearing blocks fixed in the channel, a rotatable shaft carried by the bearing blocks, a pair of spaced pole engaging arms threaded onto the shaft having one with left hand threads and the other with right hand threads providing simultaneous and different directions of movement for the arms, and a rope operated pulley fixed on an end of the shaft outside the plane of the ladder and being operated at the bottom of the ladder for clamping and releasing the arms relative to the pole.

DETAIL DESCRIPTION

A safety attachment secures the upper end of the ladder from disengagement with a pole or the like and protects a person working on the ladder from being discharged therefrom and falling to the ground with possibly great bodily injury. This attachment permits the ladder to be attached to a pole, tree or any object which may be at least partially encircled to prevent separation of a ladder therefrom. The attaching mechanism allows the user to secure the top of the ladder to a pole or tree while remaining on the ground. The securing mechanism prevents any lateral movement of the ladder at the top while a work person climbs it or while the user is accomplishing a work task on the ladder near the top thereof. This device would also allow for further adjustment while on the ladder.

The mechanism includes two opposed bowed arms semicircular in shape, each attached to a guide block which moves within a channel. The channel is attached to the side rails of the ladder on each side near the top rung of the ladder. The guide block provides the means of operation of the arms through an ACME threaded shaft. The shaft is threaded right and left handed thus allowing the guides and arms to either open or close in one movement of the shaft. The threaded shaft is held in place by a bearing block at each end of the channel. The bearing blocks are secured to the inside of the channel thus preventing the possibility of the guide blocks slipping out of the channel. At one end of the threaded shaft a pulley is fixed thereto and is operated by a rope, which passes over the pulley; the rope ends are accessible to the user both at the top and at the base of the ladder and may be removably secured to the ladder.

Figure 1:
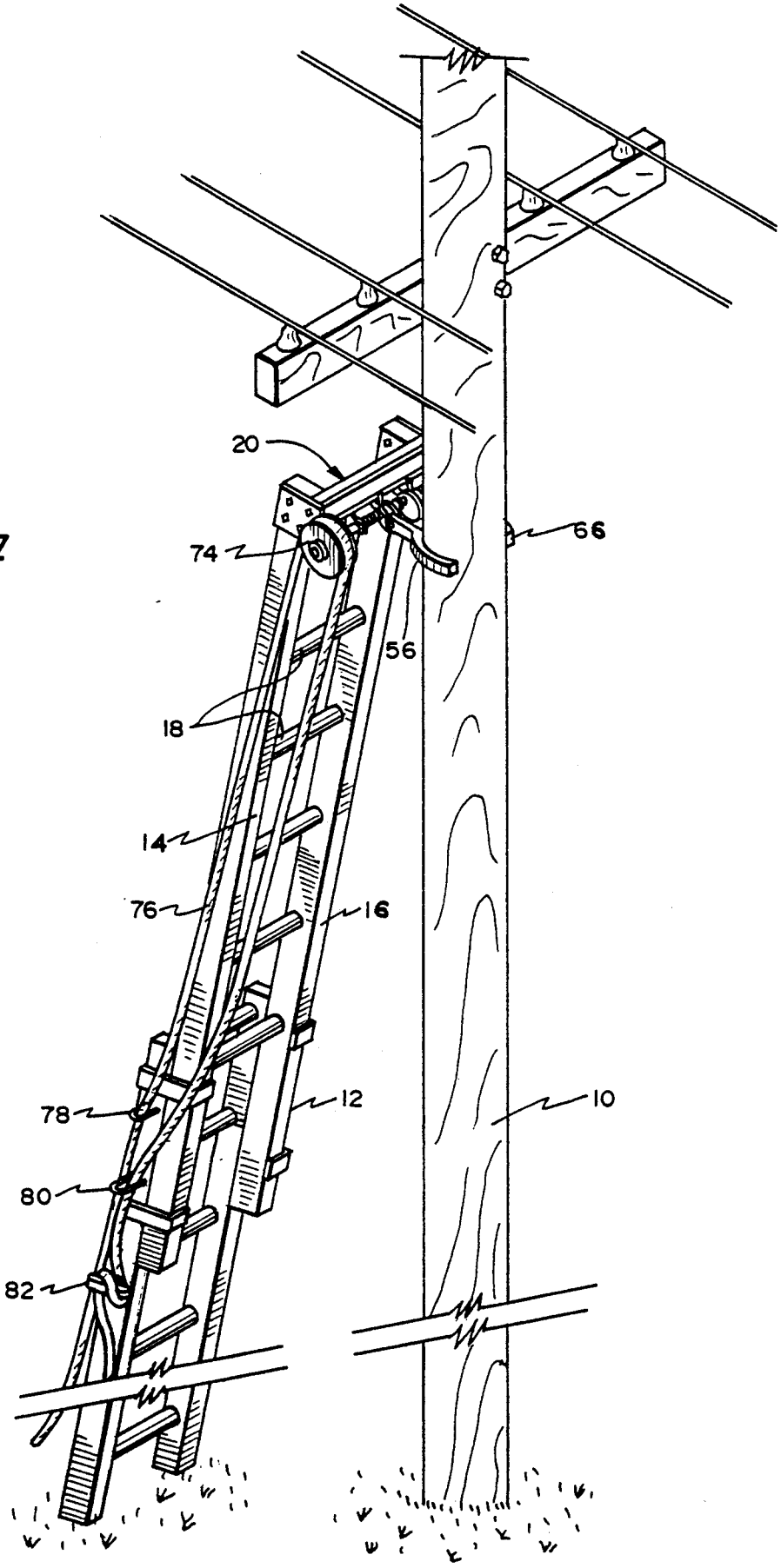
FIG. 1 is a perspective view of a utility pole and a ladder embodying the present invention of a safety attachment securing the ladder top to the pole.

As is illustrated in FIG. 1, the present invention is embodied in a safety attachment for clamping a ladder to a pole 10, such as a utility pole made of metal and/or wood. The ladder 12 is of well known construction made of wood, aluminum, fiberglass, etc. with a pair of spaced vertical rails 14 and 16 with step rungs 18 therebetween. While the ladder 12 is shown as an extension ladder, it may also be a single straight ladder inasmuch as the safety attachment 20 is shown on the upper portion thereof.

Figure 4:
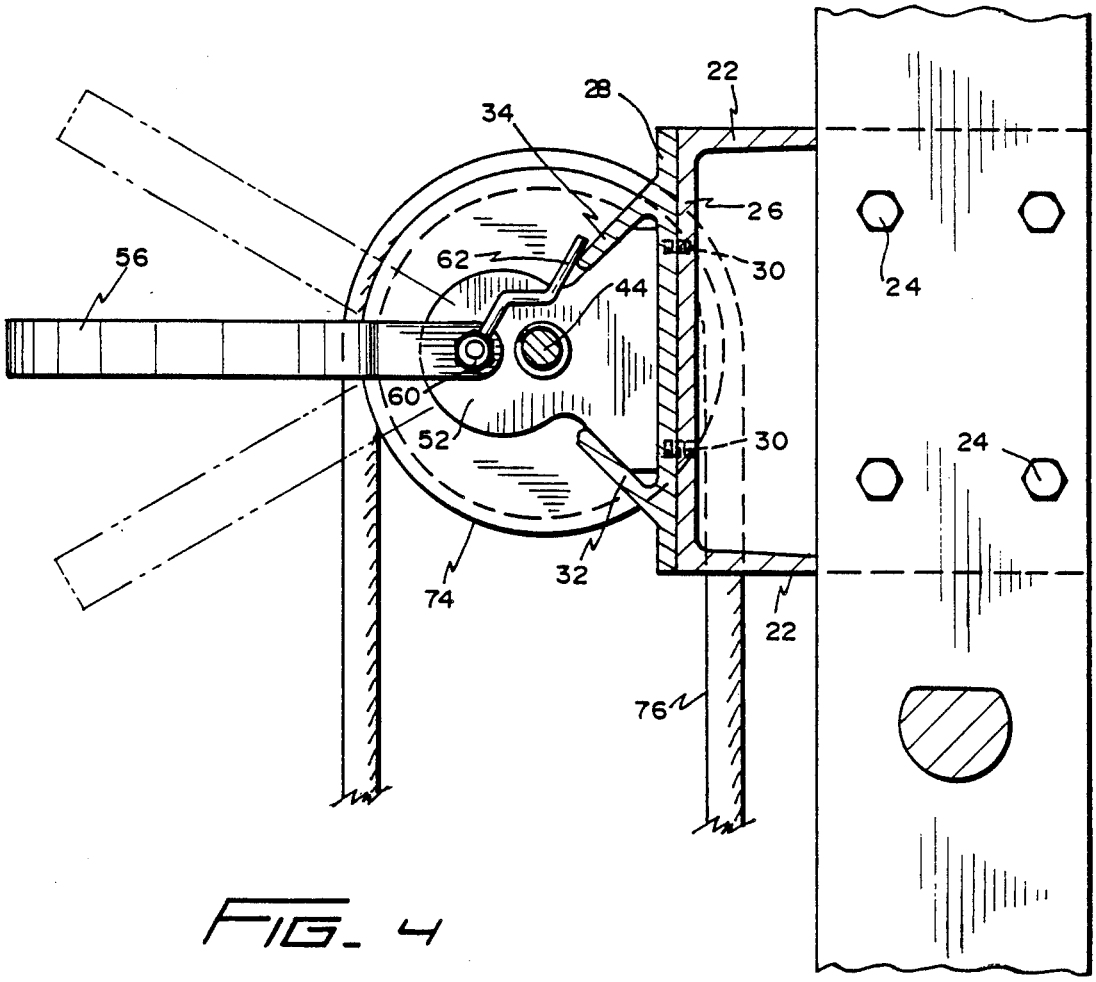
FIG. 4 is a vertical cross section view taken along line 4—4 of FIG. 3 with adjusted positions of parts shown in dashed lines.

A pair of support plates 22—22 are secured to the ladder rails 14 and 16 by any suitable fastening means, such as nut and bolt assemblies 24. A mounting plate 26 integal with the support plates 22 extends therebetween, (see FIG. 4). An extruded element 28 includes a flat surface secured to the mounting plate 26 as by set screws 30. Converging flanges 32 and 34 are integrally formed with the extruded element 28 and converge toward each other and away from the ladder 12 to define a v-shaped channel 36 open at its apex.

Figure 2:
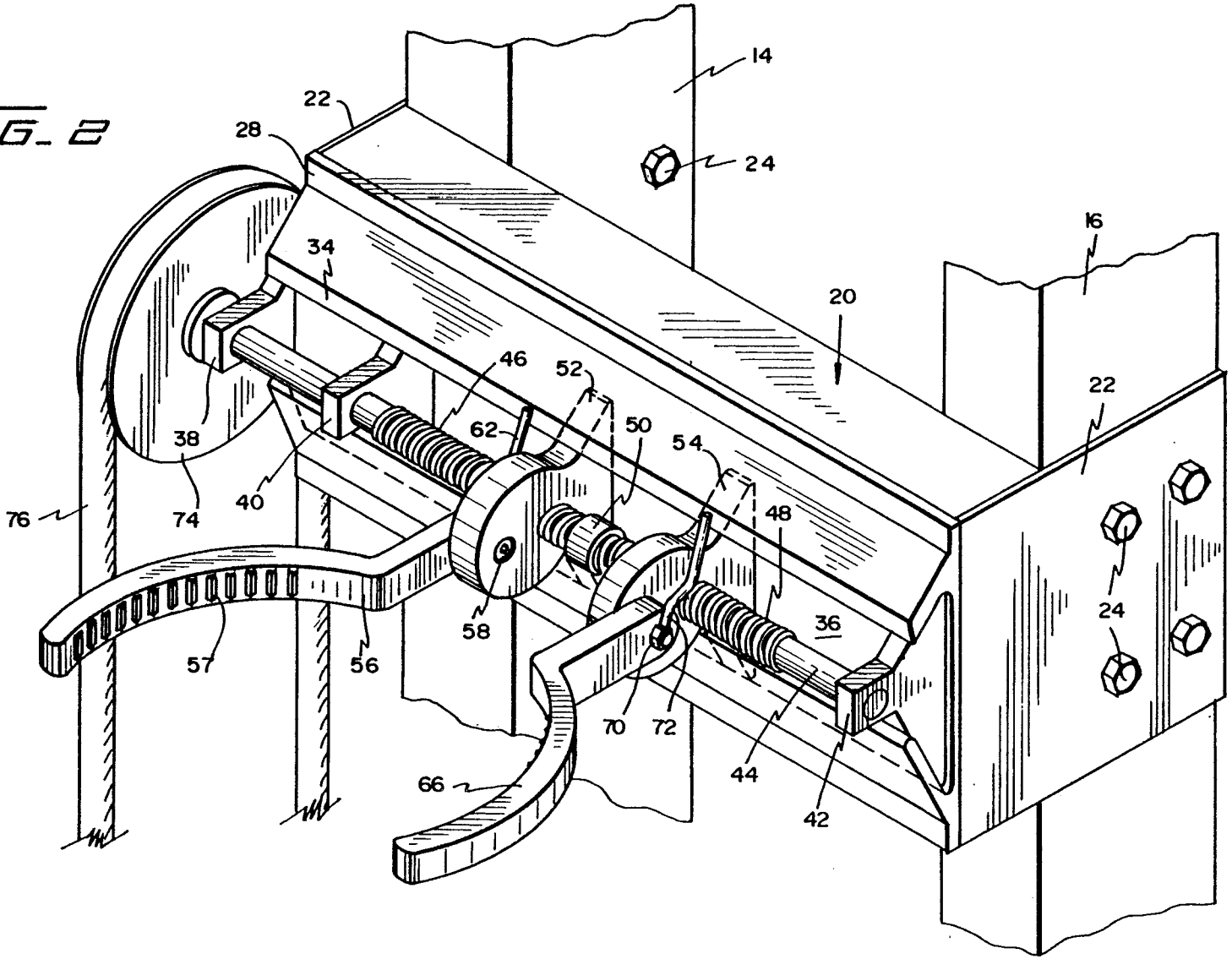
FIG. 2 is a partial, enlarged perspective view of the upper part of FIG. 1 with the pole removed.

As is shown in FIG. 2, three bearing blocks 38, 40 and 42 are spaced from each other and fixed in the v-shaped channel 36 (by the same set screws 30 in the mounting plate 26) with block 38 being on the same end as ladder rail 14 and block 42 being on the same end as ladder rail 16; the intermediate bearing block 40 is also located in the channel 36 slightly spaced from the first block 38. Each bearing block has a squared end projection provided with a central bore through which a rotatable shaft 44 is journaled. Between the blocks 40 and 42, the shaft 44 has a left hand threaded section 46 and a right hand threaded section 48 with a stop collar 50 therebetween. A pair of spaced guide blocks 52 and 54 are slidably disposed in the v-shaped channel 50 on opposite sides of the stop 50. Guide block 52 has a central bore which includes left hand threads engaging the shaft left hand threads 46; similarly, guide block 54 has a central bore which includes right hand threads 48. The threads 46, 48 and their engaging threads are ACME threads to insure greater meshing strength and stability.

Figure 3:
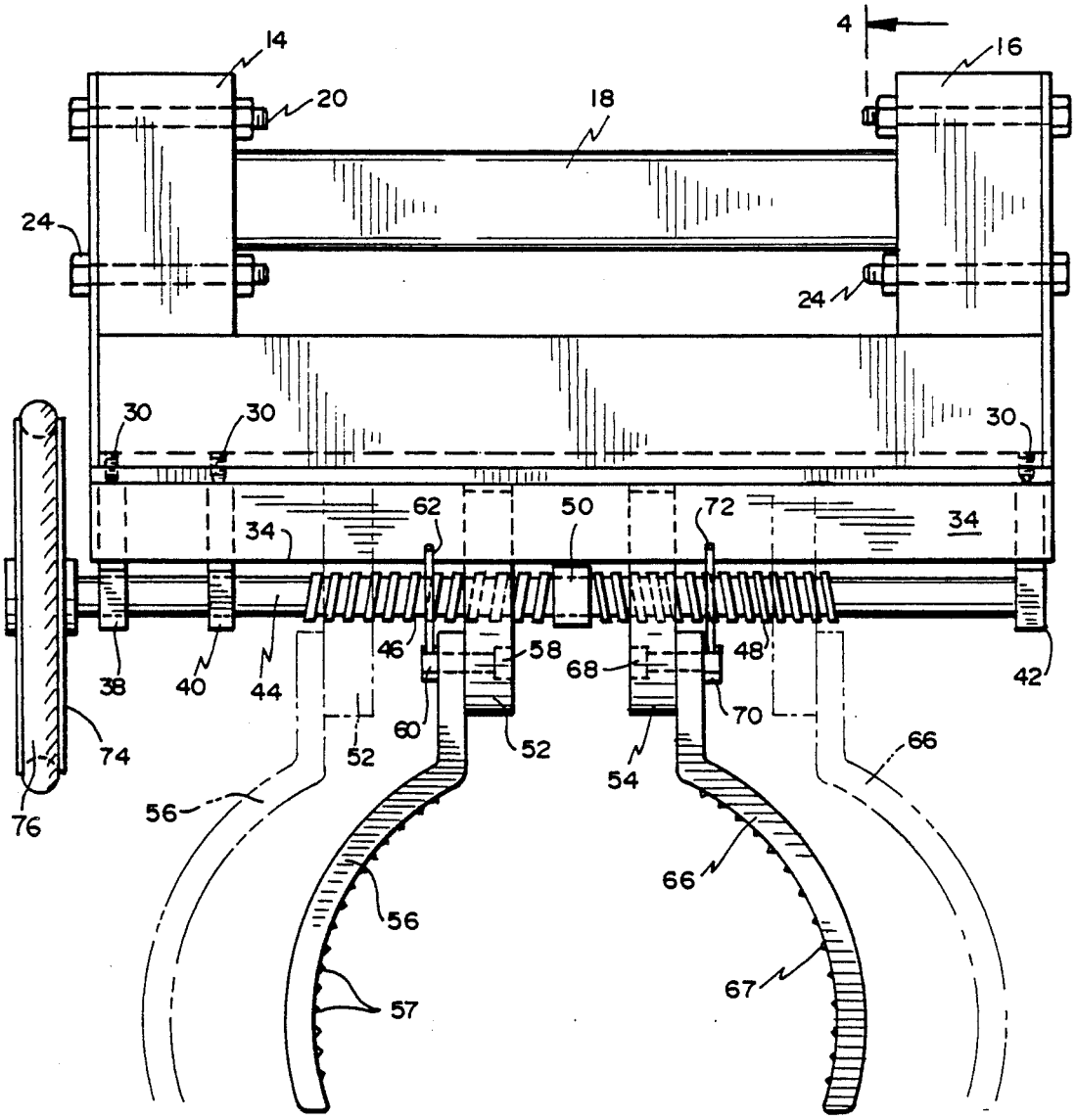
FIG. 3 is a top plan view of FIG. 2.

The left hand guide block 52 as seen in FIG. 3 defines a carrier for a pole engaging arm 56 connected to the guide block 52 by means of a hex socket bolt 58 and nut 60; an adjustable locking handle 62 has one end fixed to the nut 60 and an opposite end engaging the upper channel flange 34. In a similar manner, the right hand guide block 54 carrying arm 66 is connected by bolt 68 and nut 70; an adjustable locking handle 72 is fixed to nut 70 and engages the channel flange 34. The locking handles 62 and 72 are effective to place their respectively engaged threads under tension and thereby lock the arms 56 and 66 in position. As is apparent from FIG. 4 the arms 56 and 66 have arcuate gripping portions and may be adjusted to selected positions (approximately 12 degrees up or down) relative to the pole 10 and/or the ladder 12. In addition, the inside faces of the arms 56 and 66 are provided with gripping teeth 57 and 67 so as to insure tight clamping to a metal pole; see FIGS. 2 and 3.

The right end of shaft 44 does not extend past its bearing block 42. The left end of shaft 44 projects axially out of its bearing block 38 a short distance to receive a grooved sheave or pulley 74. As is shown in FIG. 3, the pulley 74 is fixed on the projecting left end of shaft 44 for unitary rotation with the shaft 44. A rope 76 is disposed in the groove of the pulley as it is wrapped around the pulley 74 with its two ends extending toward the bottom of the latter. One end of the rope 76 extends through a v-shaped retainer 78. The other end of the rope 76 extends through another v-shaped retainer 80 and thence around a cleat 82.

When placed in operation, the safety attachment 20 on the top of the ladder 12 is disposed with the arcuate gripping portions of arms 56 and 66 facing each other. The operator or utility man on the ground may then manipulate the rope 76 so as to move the arms 56 and 66 whereby their arcuate gripping portions are clamped against the pole 10. Rotation of the pulley 74 in a first direction cause rotation of the shaft 44 whereby the guide blocks 52 and 54 are moved axially along the shaft threads 46 and 48, respectively; the first direction would cause the arms 56 and 66 to move toward each other into a clamping position as seen in FIG. 1. Rotation of pulley 74 in an oppostie second direction, moves the arms away from each other to a released position.

It is to be noted that the present invention presents an advantage result in permitting the attachment 20 to be operated by a person on the ground in establishing a secure clamping position onto the pole 10 at the top of ladder 12. In addition, the releasing of the attachment 20 does not have to be performed by a person who is at the top of the ladder. With the present invention, the number of people falling from the top of the ladder causing serious injuries and/or deaths are greatly reduced.

The present invention has another safety feature in that the pulley 74 is located outside the plane of the ladder 12 and thus does not interfer with a utility man working at the top of the ladder as when working on telephone and/or power lines. Furthermore, the attachment device 20 may be clamped, released, and angularly adjusted at the top of the ladder 10; such operations may be needed to finely compensate for inaccuracies by the operator when and if initially made at the bottom of the ladder 10.

The location of the pulley 74 on the free end of shaft 44 outside of the ladder rail 14, leaves the top center of the ladder unencumbered so as not to impair the movements of a person working at the top of the ladder and to assure his safety.

Inasmuch as the present invention is subject to many modifications and changes in details, it is intended that all matter contained in the foregoing presentations or shown in the accompanying drawings shall be interpreted as illustrative and not in a limiting sense.

I claim:

1. A safety attachment for a ladder adapted to clamp the ladder to a utility pole or the like comprising a support mount adapted to be secured to rails of the ladder, a channel member carried by said mount and having convergent flanges with spaced apart end portions, bearing blocks fixed in said channel member adjacent opposite ends of said channel member, a screw shaft rotatably mounted in said respective bearing blocks, said shaft including a right hand threaded portion and a left hand threaded portion and a stop element centrally fixed therebetween a right hand threaded guide block operatively disposed on said right hand threaded portion of said shaft and a left hand threaded guide block operatively disposed on said right hand threaded portion whereby rotation of said shaft causes axial movement of said guide blocks toward and away from each other, a pole engaging arm on each guide block for movement therewith, said shaft having a free end extending beyond its adjacent bearing block so as to be outside of the ladder rail, a pulley fixed on said free end; and a rope looped over said pulley and having end portions extending toward the bottom of the ladder whereby an operator at the bottom of the ladder may rotate said pulley and said shaft for movement of said guide blocks causing said arms to release and engage the pole.

2. For use with the upright rails of a ladder, a safety ladder attachment device for securing a ladder at its upper end to a pole or like support, comprising transverse anchor means adapted to be rigidly secured to the upper ends of the rails of a ladder, an extruded v-shaped channel having an open bottom and secured to said anchor means with the open bottom being directed toward the front of the ladder, a plurality of spaced bearing blocks fixed in said channel, a screw shaft carried by said bearing blocks and being rotatable therein and having right and left handed threads extending off from the center of said shaft toward the ladder rails, a pair of spaced guide blocks movable in said channel and being threadedly engaged with said screw shaft for movement toward and away from one another in equal amounts of shaft travel, a pole engaging arm pivotally carried by each guide block, locking means on said arms for locking the pole engaging arms in a desired horizontal attitude relative to the ladder rails, and drive means including a sheave connected to rotate the screw shaft to causing movement of the pole engaging arms toward and away from one another from either the top or bottom of the ladder.

3. A ladder attachment device as claimed in claim 2 wherein said screw shaft includes a pair of right and left handed externally threaded sections and free ends journaled for rotation in said bearing blocks.

4. A ladder attachment as claimed in claim 3, wherein said guide blocks are threaded internally complemental to external threading of the sections of screw shaft over which the guide blocks transverses.

5. A ladder attachment as claimed in claim 4, wherein the drive means includes a rope on said sheave to adjust the positioning of said pole engaging arms from both the top of and the bottom of the ladder.

6. A ladder attachment as claimed in claim 5, wherein said arms are bowed outwardly to grip and partially encircle a pole or the like.

7. A ladder attachment as claimed in claim 6, wherein inside bowed portions of said arms have gripping aids to assist the arms in a non-slip gripping of the pole.

8. A safety attachment for a ladder as claimed in claim 1, wherein each arm is pivotally connected to its guide block, and means for such a connection includes a threaded bolt having an external nut which bears against the arm and an adjusting handle extending off the nut for locking the guide block in position.

9. For use with a ladder having a pair of upstanding rails, a safety ladder attachment for securing a ladder at its upper end to a pole or like support, an extrusion having convergent flanges and a back wall, said convergent flanges being spaced apart at their convergent ends to define an opening, a pair of bearing blocks secured proximate the ends of said convergent flanges, an ACME threaded shaft journaled for rotation in said bearing blocks, stabilizer guides mounted on said ACME threaded shaft for movement toward and away from one another, pole engaging members pivotally mounted on said stabilizer guides and passing through the opening between said convergent flanges and movable toward and away from one another, means carried by said extrusion adapted for mounting it to an upper part of the ladder, and means connected to rotate said ACME threaded shaft from either the base of the ladder and from proximate said shaft at the upper part of the ladder to move the pole engaging members toward and away from one another relative to the pole, means conected between said pole engaging memebers and said stabilizer guides to control the angle of inclination between the pole and the ladder rails without interfering with back and forth movement of the stabilizer guides in engaging and disengaging the pole engaging arms relative to the pole, and means for attaching said extrusion to the upper part of said ladder.

* * * * *